US005655184A

United States Patent [19]

Bergen

[11] Patent Number: 5,655,184

[45] Date of Patent: Aug. 5, 1997

[54] IONOGRAPHIC PRINTING WITH IMPROVED ION SOURCE

[75] Inventor: Richard F. Bergen, Ontario, N.Y.

[73] Assignee: Xerox Corporation, Stamford, Conn.

[21] Appl. No.: 537,016

[22] Filed: Oct. 2, 1995

[51] Int. Cl.[6] ..... G03G 15/05

[52] U.S. Cl. ..... 399/135; 347/123

[58] Field of Search ..... 355/200, 210, 355/219, 221, 222, 225; 347/111, 120, 123; 430/53; 399/100, 130, 135, 168, 169, 170

[56] References Cited

U.S. PATENT DOCUMENTS

| | | | |
|---|---|---|---|
| 4,435,066 | 3/1984 | Tarumi et al. | 347/123 |
| 4,763,141 | 8/1988 | Gundlach et al. | 347/123 |
| 4,839,670 | 6/1989 | Snelling | 347/123 X |
| 4,875,062 | 10/1989 | Rakov | 347/123 |
| 5,153,435 | 10/1992 | Greene | 347/123 X |
| 5,206,670 | 4/1993 | Nishikawa | 347/123 |
| 5,257,045 | 10/1993 | Bergen et al. | 347/123 |
| 5,450,103 | 9/1995 | Kubelik | 347/123 |
| 5,450,115 | 9/1995 | Bergen et al. | 347/123 |

*Primary Examiner*—Sandra L. Brase
*Attorney, Agent, or Firm*—Lloyd F. Bean, II

[57] ABSTRACT

An ionographic printer bar directs a stream of ions from an integral ion source having a planar surface for emitting ions to a charge receptor to create an electrostatic latent image thereon. The ion stream passes through an aperture having associated therewith a focusing pinch electrode for narrowing the ion stream to a preselected width, displacing electrodes for positioning the narrowed ion stream within the aperture, and focus electrodes. The integral ion source is placed in propinquity in relation to the ionographic printer bar. The planar design of ion source allows reduce size of the ionographic printer bar because no support frame is needed and allow increase robustness of the ionographic printer bar which makes it easy to install in a machine and easy to clean.

18 Claims, 7 Drawing Sheets

IONOGRAPHIC PRINTING WITH IMPROVED ION SOURCE

This application incorporates by reference U.S. Pat. No. 5,257,045, assigned to the assignee hereof. Cross-reference is also made to co-pending U.S. patent application Ser. No. 8/331400 (attorney docket no. D/94298), entitled "Improved Apparatus for Ionographic Printing with a Focused Ion Stream," assigned to the assignee hereof and U.S. patent application Ser. No. 8/355577 (attorney docket no. D/93682), entitled "Corona Generating Device" assigned to the assignee hereof.

The present invention relates to ionographic printers, and more particularly, to an improved ion source, in combination with iongraphic print bar which offers improved ion current density through the ion control device, thereby permitting higher writing speed.

In electrophotographic printing, an electrostatic latent image is formed on a charge retentive surface. In the well-known process of xerography, the original electrostatic latent image is formed by providing a photosensitive charge-retentive surface, known as a "photoreceptor," which typically is first charged and then caused to discharge in areas corresponding to the image to be printed when an original light image to be copied is focused on the photoreceptor. The white areas of the original image cause the corresponding areas on the photoreceptor to discharge, while the printed areas (such as alphanumeric characters) on the original image create corresponding dark areas on the photoreceptor, on which the original charge is retained. This latent image is developed by causing toner particles to adhere to the charged areas on the surface. The toner forming this developed image on the surface is then transferred to a sheet, such as of paper, and then the toner is fused on the sheet to form a permanent image.

Another type of printing is known as ionography. In ionography, instead of using light to selectively discharge areas of a charged photoreceptor, a charge-retentive surface is charged in an imagewise fashion by the direct application of ions onto the charge retentive surface, known simply as a charge receptor. U.S. Pat. No. 5,257,045 describes a particular kind of ionography which utilizes a "focused ion stream." In this type of ionography, a continuous stream of ions are emitted from an ion source, such as a corona wire, and are made available to a charge receptor on which a latent image is to be created. Disposed between the ion source and the charge receptor is an ion deposition control device, which is preferably in the form of a substrate interposed between the ion source and the charge receptor. The control device includes a plurality of apertures therein, through which ions can be selectively admitted from the ion source to selected positions on the charge receptor, in order to form a latent image. Each of the apertures in the row has associated therewith a "pinch electrode" and one or more "displacing" electrodes. The purpose of the pinch electrode is to isolate a stream of ions from the radiations of ions which are generally being broadcast from the ion source and, in effect, to "funnel" this particular ion stream down to a predetermined cross-sectional width. By thus focusing an ion stream to a predetermined width, the ion stream can be directed to a suitably small spot size on the charge receptor, which in turn enables the creation of high-resolution latent images on the charge receptor. While the pinch electrode focuses an ion stream onto a small area on the charge receptor, the displacing electrodes are used to direct this narrow beam of ions to the desired location on the charge receptor, so that a desired small area on the charge receptor may be charged according to its location in a desired image to be printed. The practical advantage of ionography with an ion stream is that the apertures can be made relatively large compared to the possible spot size of charged areas on the charge receptor, and therefore the ion deposition control device can be made quite cheaply.

The present invention represents practical improvements to the ionographic printing system disclosed in the patent incorporated by reference.

In the prior art, U.S. Pat. No. 4,675,703 discloses an ionographic printer in which a solid dielectric member having a control electrode and a driver electrode disposed at opposite phases thereof, to cause the formation of ions in a region adjacent the controlled electrode. A screen electrode and a deflection electrode modulate the flow of ions to a charge receptor. The screen electrode is maintained at a fixed potential to control passage of ions through one or more apertures therein, while the deflection electrode provides further control over the size, shape and location of the electrostatic images created on the charge receptor. The deflection electrode may take the form of a conductive member on one side of the ion path, or two or more conductors straddling this path.

U.S. Pat. No. 4,763,141 discloses an ion source in which a corona wire is located 1–5 mm away from biased conductive plates which form a slit that allows ions to pass therethrough onto a receptor surface. The conductive plates are used to control the flow of ions through the slit and opposing wedges are positioned on each conductive plate to focus additional ions to the center of the slit. At the inside edges of the slit are additional fringe electric fields that aid in pumping the ions out of the slit.

U.S. Pat. No. 5,325,121 discloses an ionographic printing system in which there are provided electrodes adjacent the ion path to a charge receptor moving in a process direction. The electrodes are biased to an AC source. The frequency of the AC is selected to sweep the ion stream in two directions, parallel and anti-parallel to the process direction. The purpose of this sweeping of the ion stream is to disperse ions over a wider area on the charge receptor, and also to correct for velocity errors in the moving charge receptor.

In accordance with the present invention, an ionographic image printing apparatus, including an integral ion source having a planar surface for emitting ions; a charge receptor; an ion deposition control device operatively interposed between the ion source and the charge receptor, the control device being adapted to narrow ions emitted from the ion source into an ion stream of a predetermined cross-sectional area, and to displace the ion stream to a predetermined position on the charge receptor.

According to another aspect of the present invention, there is provided an ionographic printing bar apparatus adapted to write images on a charge receptor, including an integral ion source having a planar surface for emitting ions; an ion deposition control device operatively interposed between the ion source and the charge receptor, the control device being adapted to narrow ions emitted from the ion source into an ion stream of a predetermined cross-sectional area, and to displace the ion stream to a predetermined position on the charge receptor.

An advantageous feature of the present invention is that the inventive ion source offers improved ion current density through the ion control device as compared to prior art devices, thereby permitting higher writing speeds. The planar design of ion source has the advantage over prior art devices in that planar surface of the ion source is placed in propinquity in relation to the ion control device therefore no support frame is needed which reduces the size of the ion control device and increases the robustness of the ion control device makes it easy to install in a machine and easy to clean.

Figure 7:
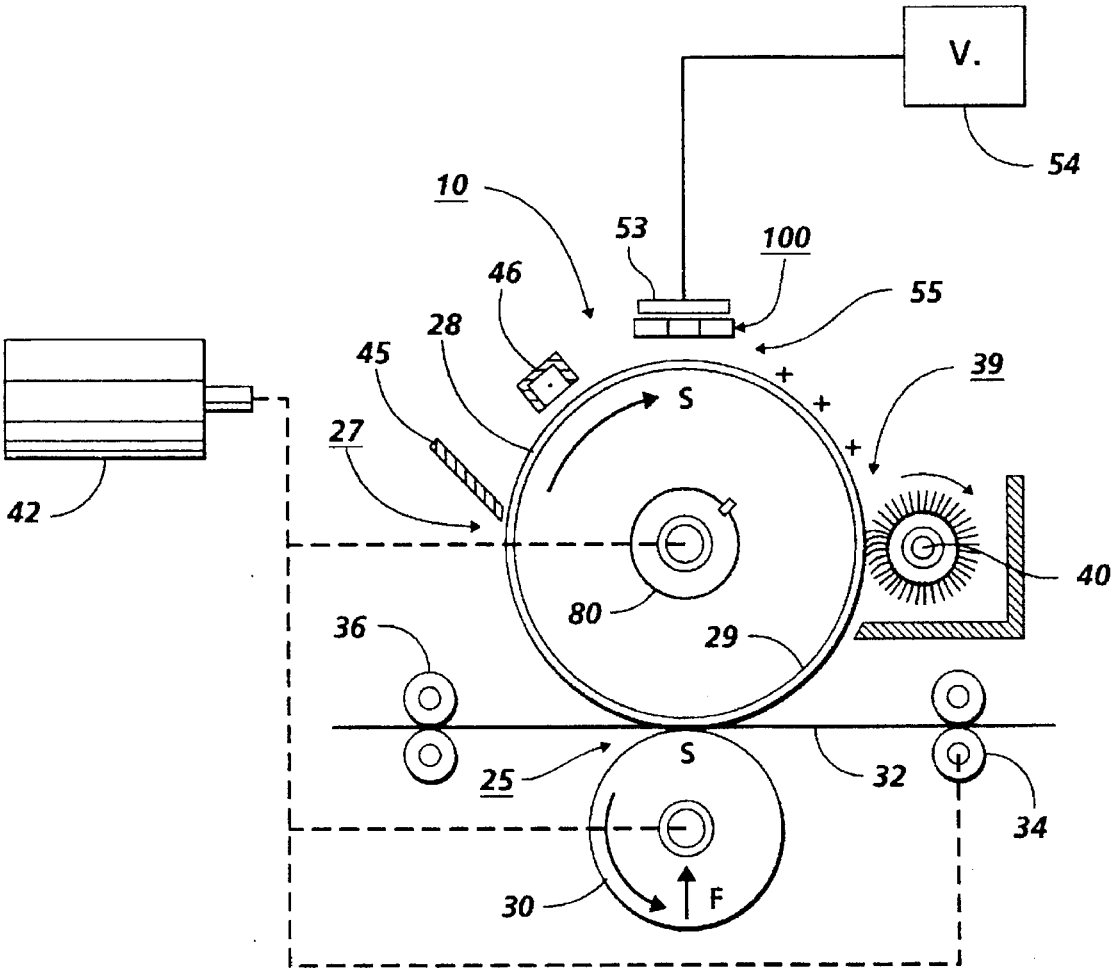
FIG. 7 is a simplified elevational view of an ionographic printer incorporating the present invention.

FIG. 7 shows the basic elements of an ionographic printer. Printer 10 includes a dielectric charge receptor 27 in the form of a conductive substrate 29, here in the form of a drum or cylinder, having an electrostatically chargeable dielectric layer on its surface 28. While the receptor of printer 10 is shown and described in the form of a drum, other receptor types, such as a belt, may be envisioned. Receptor 27 is suitably supported for rotation in the direction shown by the solid line arrow in a suitable housing (not shown). In the example embodiment shown, a pressure cylinder or roller 30 is rotatably supported below receptor 27 and in operative relation thereto, at transfer station 25, roller 30 cooperating with receptor 27 to define a nip through which copy sheets 32 may pass. Roll pair 34 on the upstream side of transfer station 25 and roll pair 36 on the downstream side of transfer station 25 are provided for bringing sheets 32 into and out of transfer relation with receptor 27 at transfer station 25. Other methods for transfer of developed images, as opposed to pressure roller 30 shown, include electrostatic transfer using one or more transfer coronodes. Other transfer methods familiar in the general art of xerography will be apparent to one skilled in the art.

Sheets 32 are supplied from a suitable source such as a paper tray (not shown) having a sheet feeder means and activated to advance the sheets forward in timed register relation with the images on receptor 27 for feeding to transfer station 25.

A developer roll 40 is provided at developing station 39 for developing the latent electrostatic images formed on receptor 27 prior to transfer. Developer roll 40 is rotatably mounted within a developer housing having a supply of toner for use of developing the electrostatic images on surface 28 of receptor 27. Developer roll 40 typically rotates in a direction opposite that of receptor 27, as shown by the arrow. Receptor 27, pressure roller 30, roll pairs 34 and 36, and developer roll 40 are suitably drivingly coupled to and rotated by a suitable motor 42.

To remove residual or leftover toner powder from receptor 27 after the transfer step, a scraper blade 45 is provided. Blade 45 engages against the surface of receptor 27 to wipe toner therefrom. A suitable erase apparatus 46 is provided downstream of blade 45, to discharge any left over charges remaining of receptor 27.

The latent electrostatic images formed in the dielectric layer forming surface 28 of receptor 27 that are thereafter developed by developer roll 40 form a toner powder image on the charge receptor. The toner powder image is then simultaneously transferred and fixed to the sheet 32 at transfer station 25 through pressure engagement between receptor 27 and roller 30. Once again, alternate transfer techiniques are well-known and applicable to the present invention.

At the beginning of the ionographic process, at a step corresponding to the top of receptor 27 as shown in FIG. 7, the originally-discharged surface 28 of receptor 27 is charged in imagewise fashion by ions emitted from source 53 generally adjacent the receptor 27 across the width thereof. The source 53 is connected to a voltage source 54. Interposed between the source 53 and the surface 28 of receptor 27 is an ion deposition control device generally indicated as 100. Control device 100 has defined therein a plurality of openings to selectably allow the passage of ions from source 53 to the surface 28 of receptor 27, as receptor 27 moves in a process direction. The imagewise deposition of ions on the moving receptor 27 is caused by selective control of the apertures in control device 100 either to permit or not permit the passage of ions therethrough in accordance with digital image data. By coordination of the imagewise modulation of the ion flow through the openings in control device 100 with the motion of receptor 27, the ions emitted from source 53 form the desired electrostatic latent image on receptor 27 for subsequent development at developing station 39 and transfer to a sheet at transfer station 25.

Figure 1:
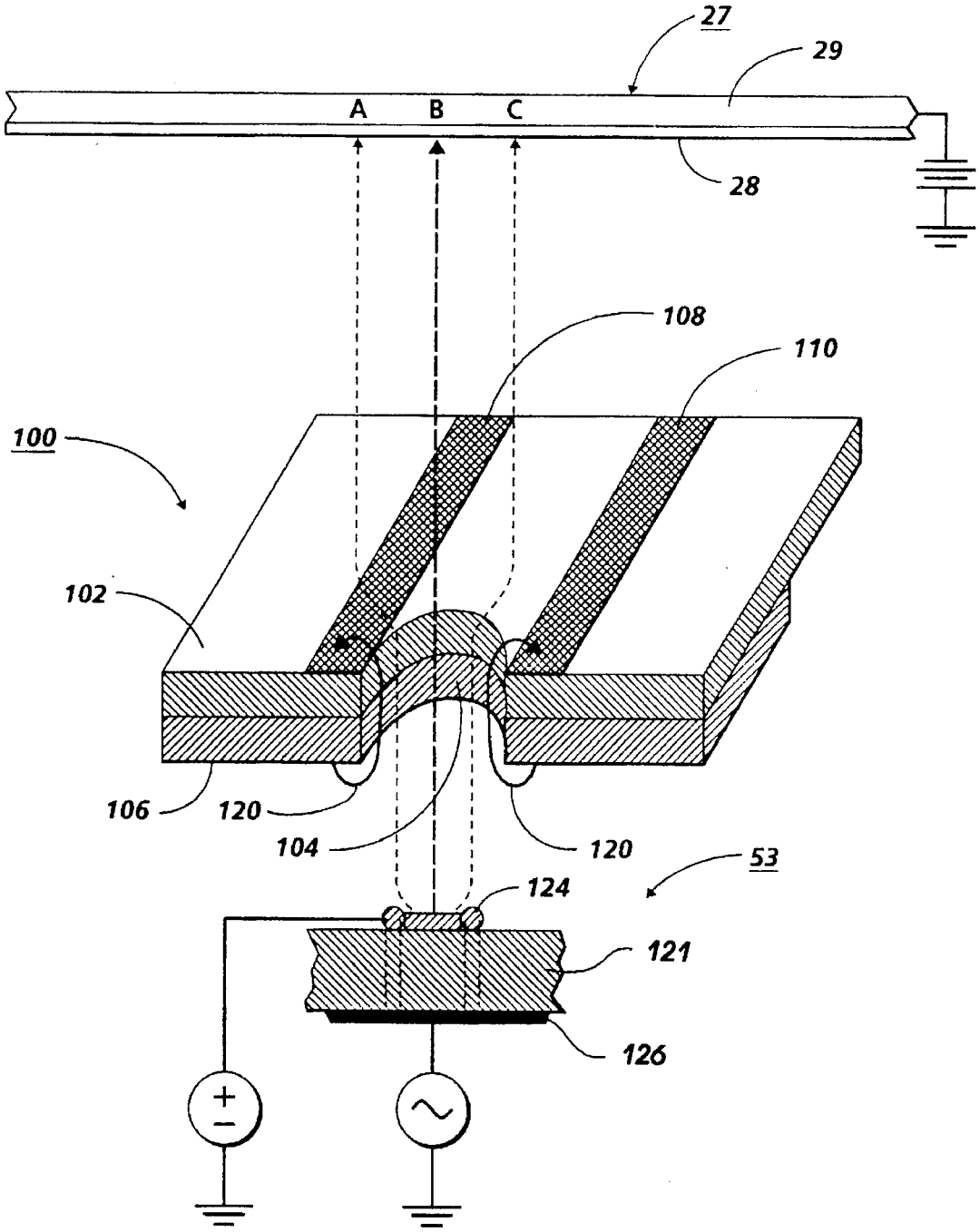
FIG. 1 is a detailed sectional elevational view of an ion stream control device according to the present invention.
Figure 2:
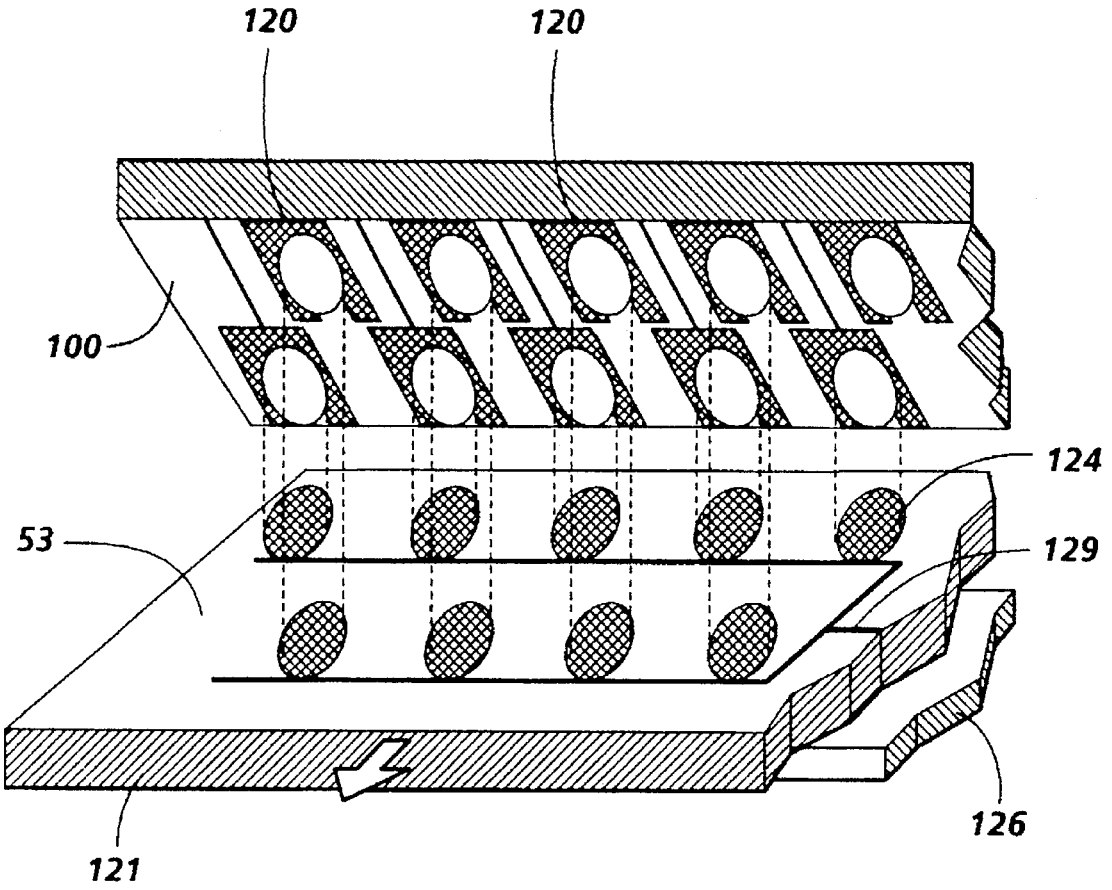
FIGS. 2–6 are sectional elevational view of embodiments of the ion stream control device according to the present invention
Figure 3:
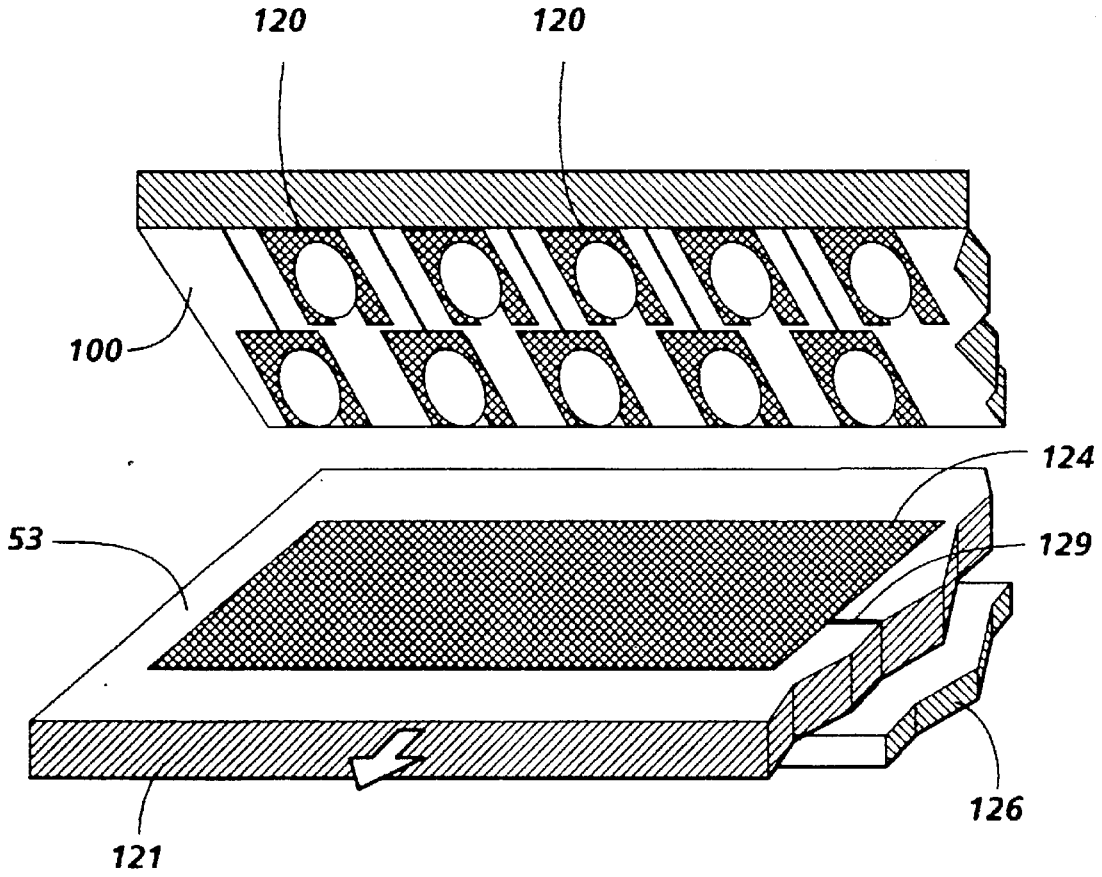
Figure 4:
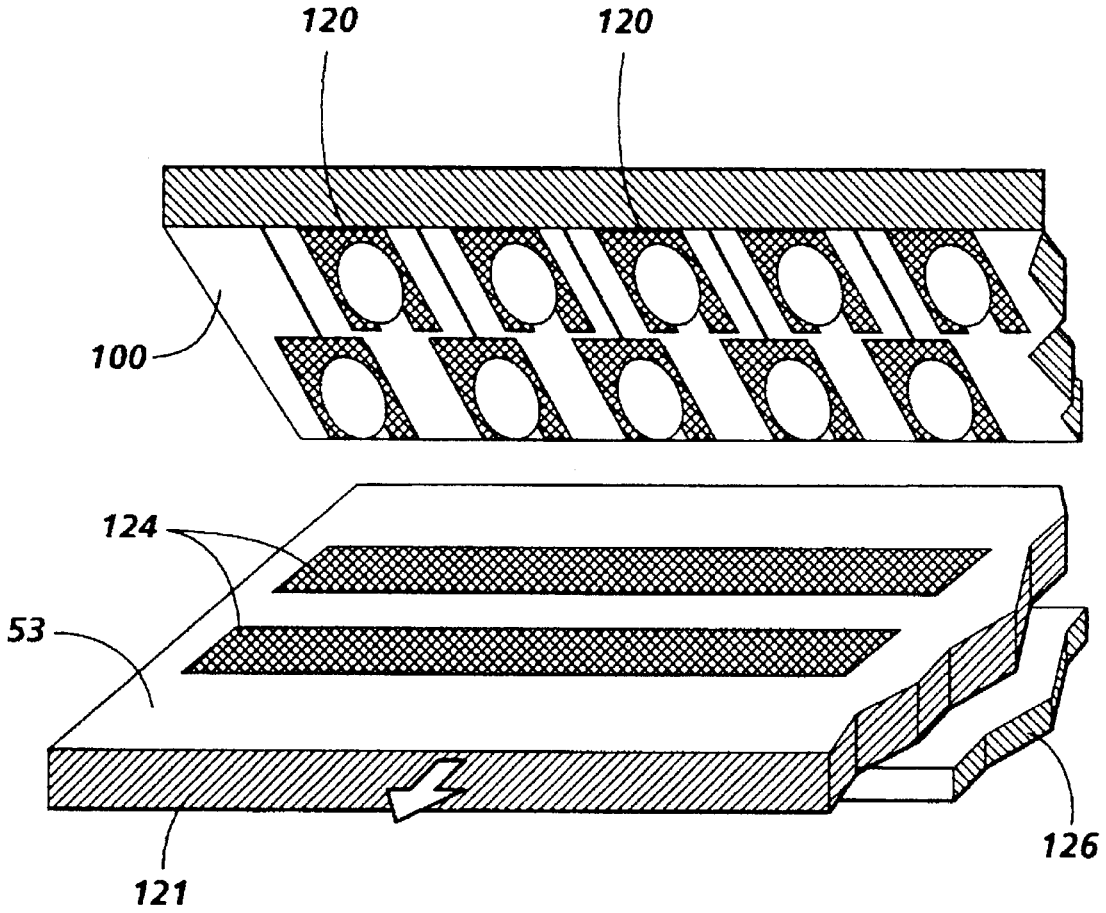
Figure 5:
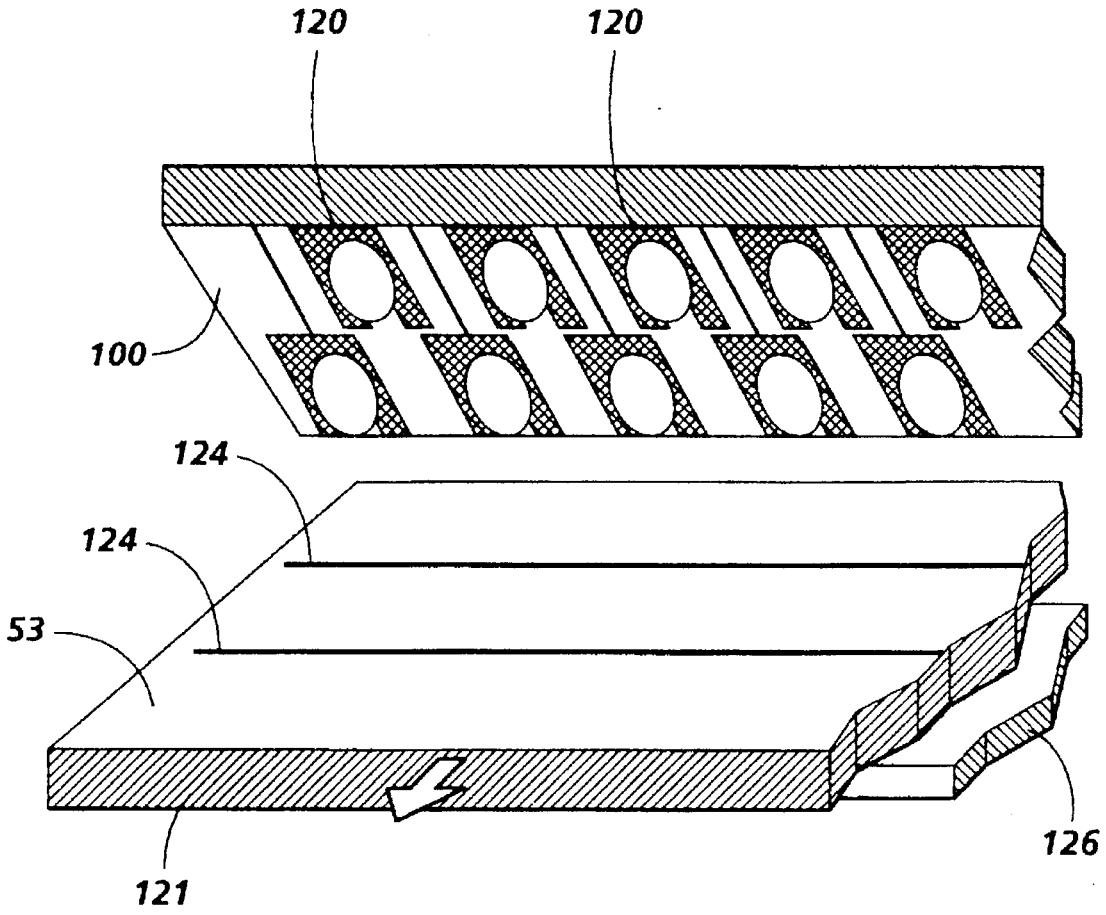

FIG. 1 is a sectional elevational view through one opening in control device 100, showing the passage of positive ions, indicated as + symbols, from the source 53 through the opening to the surface 28 of receptor 27. Although a source of positive ions is shown in the present embodiment, it will be understood that the invention could be made to work with a source of negative ions as well. With reference to FIGS. 1 and 2A–D planar ion source 53 includes a low DC voltage, e.g. 1000 V, which is electrically connected to an upper electrode(s) 124. A high AC voltage, e.g., 4 kVp-p, which is electrically connected to a lower electrode 126. Both electrode 126 and 124 comprise suitable conductive materials such as copper or palladium silver in a ceramic or glass binder, all of which are supported on the top and bottom surfaces of insulating/dielectric support 121, preferably containing between 50% to 100% of alumina ($Al_2O_3$). Upper electrode 124 has a pattern on the top surface of insulator support 121 for potential leveling purposes and has a low voltage. The pattern can be any desired shape, for example, preferably a pattern as shown in FIG. 2, a plurality of circular shapes having a screen pattern. The circular shapes are positioned to correspond to the opening 104 defined therein for the passage of ions therethrough in device 100. In operation, corona forms above the opening 104 defined therein for the passage of ions therethrough in device 100. An advantageous feature having a independent source for each opening is that the ion stream input to the holes surrounded by the pinch electrode can be maximized. Corona will form only around the circle periphery and the field lines will drive the ions to the pinch electrodees, where the field lines will funnel this circular ion stream. Other patterns can be also employed which can be positioned over under the openings such as a slit like pattern (as shown in FIG. 4); a grid-like pattern (as shown in FIG. 3) or a line or lines (as shown in FIG. 5) can be employed. It is desirable to apply an insulating overcoat on AC lower electrode 126 and electrical connecting lines 129 for preventing corona formation thereon. Also, It is desireable to have lower electode a corresponding pattern as the upper electode. In operation of ion source 53 the AC lower electrode on one side of a substrate provides fields that generate corona within the screen apertures on the upper electrode. DC potential applied to the upper electrode, such as a screen, provides the fields to drive and level charges to the charge retentive surface. Referring to FIG. 1, corona is produced on the edges of the pattern. For example, a screen pattern corona is produced in the screen apertures, at the edges of the screen and the field due to the voltage on the screen, and drives the ions to device 100 onto the imaging receptor.

Device 100 comprises an insulative substrate 102 having an opening 104 defined therein for the passage of ions therethrough. On the side of the substrate 102 facing the source 53 and, in this embodiment, substantially surrounding the entire edge of opening 104 is what shall be referred to herein as "pinch" electrode 106. Source 53 is placed in propinquity in relation to substrate 102 between from in contact to about 0.25" from substrate 102. On the side of substrate 102 facing receptor 27 are a first displacing electrode, indicated as 108, and a second displacing electrode, indicated as 110. As shown in FIG. 1, the displacing electrodes 108 and 110 are placed on the side of the substrate 102 facing receptor 27 and configured such that the displacing electrodes 108 and 110 are disposed on opposite sides along the edge of opening 104, and therefore electrically separated.

In operation, ions are caused to pass from the source 53 through control device 100 to receptor 27 in the following manner. Leaving aside for the time being considerations of placements of ions on a specific area of the receptor 27, the ions from source 53 are caused to move in the desired manner due to the potential difference between the source 53 and pinch electrode 106. This creates a "potential well" to drive the ions in the control device 100. The pinch electrode 106, the displacing electrodes 108 and 110, and the receptor 27 are respectively biased from high to low potentials, or specifically from more positive to less positive voltages, in that order. For example, typical values of DC bias for the respective elements would be as follows: the corona wire in source 53, +5000 volts; the pinch electrode 106, +1300 volts; displacing electrodes 108 and 110, +1000 volts each; and surface 28 of receptor 27, 0 volts. In general, the relative values of these biases are more important than their absolute values; the zero point in this descending order of DC biases is not important as long as the descending order is maintained. It is possible that surface 28 of receptor 27, for example, may have a very small positive bias, zero bias, or a negative bias, as long as a potential well effect is maintained. As the ions emitted from source 53 are of a positive charge, a negative bias on the surface 28 of receptor 27 will advance the passage of ions thereto.

When the pinch electrode 106 and the displacing electrodes 108 and 110 are biased to form a potential well, these electrodes create "pumping" electric fields on either side of opening 104, the fields being generally in the direction of an ion stream passing from source 53 through opening 104 to receptor 27. In the case where there is no lateral displacement of the ion stream through opening 104, the ions from source 53 will pass straight through opening 104 and "land" on surface 28 at the point marked B. One specific function of the pinch electrode 106 is to control the width of the ion stream passing through the opening 104. These pumping fields, such as that shown by arrows 120, have the effect of "catching" the ion stream from source 53 (the ions being naturally attracted to progressively lower potentials) and, in effect, focusing or acting as a funnel to draw the ion stream through opening 104. As pinch electrode 106 is biased more positively relative to either of the displacing electrodes 108 or 110 on the other side of substrate 102, the pumping fields are caused to loop through the opening 104 from pinch electrode 106 to either of the displacing electrodes 108 or 110. The strength of these fields 120 serve to control the width of the ion stream through opening 104. The bias on pinch electrode 106 therefore serves to collect and "pinch," or narrow, the width of the ion stream. The width of the resulting stream can be made significantly smaller (e.g., one-third to one-tenth the diameter, or even smaller) than the opening 104 itself. This pinching of the ion stream can be exploited to increase the resolution of an electrostatic latent image on receptor 27, as will be described in detail below.

While the pinch electrode 106 is used to control the width of the ion stream, displacement electrodes 108 and 110 are used to displace the position of the ion stream within the opening 104, and therefore to "aim" the pinched ion stream to a specific desired area on the receptor 27. Because, by virtue of the pinch electrode 106, the width of the ion stream can be made small relative to the width of the opening 104, the ion stream may be placed on the receptor 27 in an area within the area of the corresponding opening, and with a resolution which is much smaller than the size of the opening 104. Displacement of the ion stream to a precise area on the receptor 27, such as the areas marked A or C on surface 28, is accomplished by adjusting the relative biases of first displacing electrode 108 and second displacing electrode 110.

Figure 6:
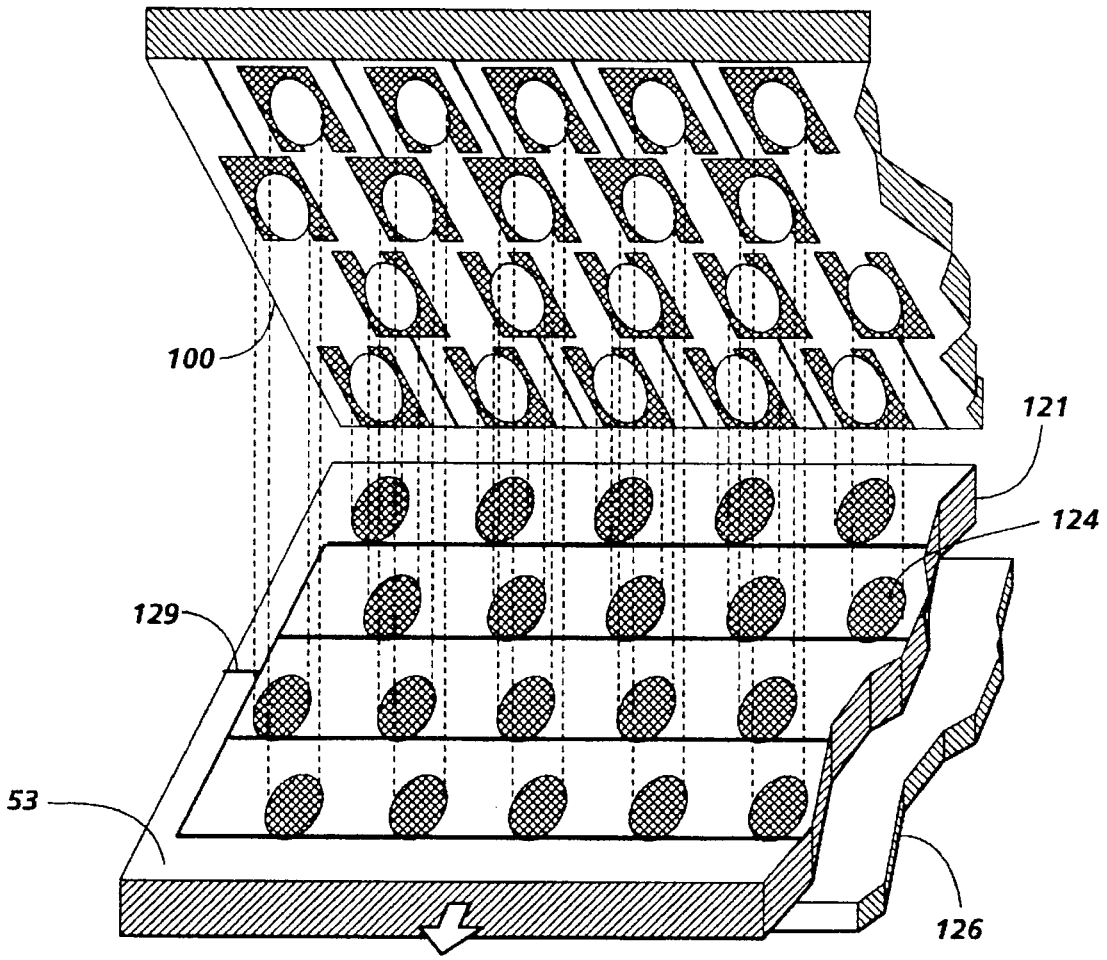

Referring to FIG. 6, higher writing speeds can be obtain by applying a cumulative charge on receptor 27 as it moves at a higher speed. In FIG. 6, a second set of openings 300 which are aligned with the first set of openings 400 along the process direction which is indicated by the arrow. In operation. the imagewise deposition of ions on the moving receptor 27 is caused by selective control of first set of openings 400 along the process direction in control device 100 either to permit or not permit the passage of ions therethrough in accordance with digital image data generating a desired electrostatic latent image on receptor 27. Digital image data is delay to the second set of openings 300 so that with the motion of receptor 27, the ions emitted from source 53 repeat the desired electrostatic latent image on receptor 27 for subsequent development at developing station 39.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An ionographic image printing apparatus, comprising:

an integral ion source having a planar surface for emitting ions wherein the ion source includes a dielectric layer, a corona producing element formed on a surface of said dielectric layer, a reference electrode, positioned on a surface of said dielectric layer, opposed from the surface having said corona producing element formed thereon for controlling charging by said corona producing element; a DC voltage source coupled to said reference electrode, and an AC voltage source coupled to said corona producing element for energizing said reference electrode element to emit ions therefrom;

a charge receptor; and an ion deposition control device operatively interposed between the ion source and the charge receptor, the control device being adapted to narrow ions emitted from the ion source into an ion stream of a predetermined cross-sectional area, and to displace the ion stream to a predetermined position on the charge receptor.

2. The apparatus of claim 1, wherein the ion deposition control device includes:

a substrate, disposed between and closely spaced from the ion source and the charge receptor, defining an aperture for passage of ions therethrough;

a pinch electrode, disposed on the substrate, including a conductive surface facing the ion source; and a displacing electrode, associated with the aperture at a first location along a length thereof, including a conductive surface facing the charge receptor, and having an edge uniformly spaced relative to a portion of the aperture edge.

3. The apparatus of claim 2, further comprising control means for applying a selected potential to the displacing electrode so that the displacing electrode displaces an ion stream passing through the aperture to a selectable extent through a first displacement path.

4. The apparatus of claim 2, wherein planar surface of the ion source is placed between from about in contact to about 0.25" from the substrate of the ion deposition control device.

5. The apparatus of claim 1, wherein said reference electrode comprises a plurality of discrete reference electrodes on the surface of said dielectric layer.

6. The apparatus of claim 5, wherein at least one of said plurality of reference electrodes is positioned in alignment with said aperture in said substrate.

7. The apparatus of claim 1, wherein said reference electrode comprises a pattern defining a grid.

8. The apparatus of claim 1, wherein said reference electrode comprises a pattern defining a slit therein.

9. The apparatus of claim 1, wherein said reference electrode comprises a pattern defining a line.

10. An ionographic printing bar apparatus adapted to write images on a charge receptor, comprising:

an integral ion source having a planar surface for emitting ions wherein the ion source includes a dielectric layer, a corona producing element formed on a surface of said dielectric layer, a reference electrode, positioned on a surface of said dielectric layer, opposed from the surface having said corona producing element formed thereon for controlling charging by said corona producing element, a DC voltage source coupled to said reference electrode, and an AC voltage source coupled to said corona producing element for energizing said reference electrode element to emit ions therefrom;

a charge receptor; and an ion deposition control device operatively interposed between the ion source and the charge receptor, the control device being adapted to narrow ions emitted from the ion source into an ion stream of a predetermined cross-sectional area, and to displace the ion stream to a predetermined position on the charge receptor.

11. The apparatus of claim 10, wherein the ion deposition control device includes:

a substrate, disposed between and closely spaced from the ion source and the charge receptor, defining an aperture for passage of ions therethrough;

a pinch electrode, disposed on the substrate, including a conductive surface facing the ion source; and a displacing electrode, associated with the aperture at a first location along a length thereof, including a conductive surface facing the charge receptor, and having an edge uniformly spaced relative to a portion of the aperture edge.

12. The apparatus of claim 11, further comprising control means for applying a selected potential to the displacing electrode so that the displacing electrode displaces an ion stream passing through the aperture to a selectable extent through a first displacement path.

13. The apparatus of claim 11, wherein planar surface of the ion source is placed between from about 0.005" to about 0.25" from the substrate of the ion deposition control device.

14. The apparatus of claim 10, wherein said reference electrode comprises a plurality of discrete reference electrodes on the surface of said dielectric layer.

15. The apparatus of claim 14, wherein at least one of said plurality of reference electrodes is positioned in alignment with said aperture in said substrate.

16. The apparatus of claim 10, wherein said reference electrode comprises a pattern defining a grid.

17. The apparatus of claim 10, wherein said reference electrode comprises a pattern defining a slit therein.

18. The apparatus of claim 10, wherein said reference electrode comprises a pattern defining a line.

* * * * *